United States Patent [19]

Naito

[11] Patent Number: 4,588,889

[45] Date of Patent: May 13, 1986

[54] SWEEPING PROCESS FOR MASS SPECTROMETER HAVING SUPERIMPOSED FIELDS

[75] Inventor: Motohiro Naito, Tokyo, Japan

[73] Assignee: Jeol Ltd., Tokyo, Japan

[21] Appl. No.: 698,039

[22] Filed: Feb. 4, 1985

[30] Foreign Application Priority Data

| | | | |
|---|---|---|---|
| Feb. 10, 1984 | [JP] | Japan | 59-21981 |
| Feb. 27, 1984 | [JP] | Japan | 59-29415 |
| May 22, 1984 | [JP] | Japan | 59-103378 |

[51] Int. Cl.[4] ..... H01J 49/32

[52] U.S. Cl. ..... 250/295; 250/296; 250/282

[58] Field of Search ..... 250/281, 282, 294, 295, 250/296

[56] References Cited

U.S. PATENT DOCUMENTS

| | | | |
|---|---|---|---|
| 3,984,682 | 10/1976 | Matsuda | 250/296 |
| 4,521,687 | 6/1985 | Naito | 250/296 |

*Primary Examiner*—Alfred E. Smith
*Assistant Examiner*—Jack I. Berman
*Attorney, Agent, or Firm*—Webb, Burden, Robinson & Webb

[57] ABSTRACT

A process of obtaining spectra of daughter ions which are produced by collision of sample ions with neutral molecules for dissociating the sample ions in a collision chamber disposed in an ion path to thereby provide a structural analysis of organic compounds. To carry out this process, a mass spectrometer is used which has mass spectrometric units located before and after the collision chamber. The spectrometric unit located behind the chamber has superimposed magnetic field B and electric field E perpendicular to the magnetic field. Daughter ions having a mass $m_x$ produced from parent ions having a mass $m_0$ inside the chamber are detected and measured by sweeping the voltage $Vd_x$ for producing the electric field or the intensity $B_x$ of the magnetic field singly or sweeping both in an interrelated manner so as to satisfy the relation $$Vd_x/V_{00} + (B_x/B_0)\sqrt{M_{00}/m_0} = m_x/m_0$$

where $V_{00}$ is the voltage for producing the electric field used to detect the parent ions having infinitely large masses, $B_0$ is the intensity of the magnetic field when the parent ions are detected, and $M_{00}$ is the mass of the parent ions detected when the intensity of the electric field is zero.

4 Claims, 7 Drawing Figures

SWEEPING PROCESS FOR MASS SPECTROMETER HAVING SUPERIMPOSED FIELDS

BACKGROUND OF THE INVENTION

The present invention relates to a sweeping process for a mass spectrometer that provides a mass analysis by collision induced dissociation or a so-called metastable ion spectrum method.

According to the collision induced dissociation method, sample ions are caused to collide with neutral molecules in a collision chamber that is disposed in the path in which the ions travel, in order to dissociate the ions. Then, spectra are obtained from the resulting daughter ions. According to the metastable ion spectrum method, the metastable ions from sample ions resolve themselves into smaller fragment particles in the Field Tree Drift Region without collision gas, resulting in daughter ions, from which spectra are derived. Both methods have evolved as useful tools for structural analysis of organic compounds or for the study of fragmentation of organic compounds.

To utilize either the collision induced dissociation or the metastable ion spectrum method, a MS/MS instrument is often employed. In this instrument, mass spectrometers are disposed before and after a collision chamber. The present inventor has already proposed a mass spectrometer taking the form of such an MS/MS instrument and in which a superimposed-field mass spectrometric unit constitutes the latter stage of the spectrometer (see U.S. Pat. No. 4,521,687). The structure of this proposed instrument is shown in FIG. 1(*a*). FIG. 1(*b*) is a cross-sectional view taken along the line A—A'. In these figures, an ion source 1, an electric field 2, and a magnetic field 3 are arranged in a conventional manner to constitute a double-focusing mass spectrometric unit. This first unit forms a point at which ions are converged, and a collision chamber 5 is located at this point. Disposed between the chamber 5 and a collector 4 is a second mass spectrometric unit having superimposed fields. Specifically, the second unit comprises magnetic pole pieces 6*a* and 6*b* for producing a magnetic field in the direction perpendicular to the page, a magnetic field power supply 7 for energizing the pole pieces, a pair of electrodes 8*a* and 8*b* for producing a toroidal electric field in the direction perpendicular to the magnetic field, an electric field power supply 9 for generating a voltage applied between the electrodes, auxiliary electrodes 10*a* and 10*b*, known as Matsuda plates, mounted between the magnetic pole pieces 6*a* and 6*b* on both sides of the toroidal field, and an auxiliary power supply 11 for applying a correcting voltage across the auxiliary electrodes. In this mass spectrometer employing the superimposed fields, the intensity of the magnetic field of the superimposed fields is switched between two levels, and at each of these levels the electric field is swept.

SUMMARY OF THE INVENTION

It is an object of the present invention to provide an improved sweeping process for the collision induced dissociation or the metastable ion spectrum method in a mass spectrometer having superimposed fields.

It is another object of the invention to provide a sweeping process capable of detecting all the daughter ions produced from specific parent ions.

It is a further object of the invention to provide a sweeping process capable of obtaining information about all the parent ions that produce specific daughter ions, the process being customarily called parent ion scan.

It is a yet other object of the invention to provide a sweeping process capable of obtaining information about all the parent ions that produce neutral molecules or particles having specific masses when they undergo cleavage, the process being customarily known as neutral loss scan.

The present invention using a superimposed-field mass spectrometer is characterized in that when daughter ions having a mass $m_x$ which are produced from parent ions having a mass $m_0$ are detected, a voltage $Vd_x$ for producing the electric field or the intensity $B_x$ of the magnetic field is swept singly or both are swept in an interrelated manner so as to satisfy the relation $$Vd_x/V_{00} + (B_x/B_0)\sqrt{M_{00}/m_0} = m_x/m_0$$

where $V_{00}$ is the voltage for producing the electric field when ions having infinitely large masses are detected, $B_0$ is the intensity of the magnetic field when the parent ions are detected, and $M_{00}$ is the mass of the parent ions detected when the intensity of the electric field is zero.

When the mass $m_y$ of all the parent ions producing daughter ions having a mass $m_1$ is measured, a voltage $Vd_y$ for producing the electric field or the intensity $B_y$ of the magnetic field is swept singly or both are swept in an interrelated manner so as to satisfy the relation $$Vd_y/V_{00} + (B_y/B_0)\sqrt{M_{00}/m_0} = m_1/m_y$$

When the mass $m_0$ of all the parent ions producing neutral particles having a mass $m_n$ by cleavage is determined, a voltage $Vd_n$ for producing the electric field or the intensity $B_n$ of the magnetic field is swept singly or both are swept in an interrelated manner so as to satisfy the relation $$Vd_n/V_{00} + (B_n/B_0)\sqrt{M_{00}/m_0} = 1 - m_n/m_0n$$

The present invention is hereinafter described in detail with reference to the accompanying drawings.

DESCRIPTION OF THE PREFERRED EMBODIMENTS

Figure 1A:
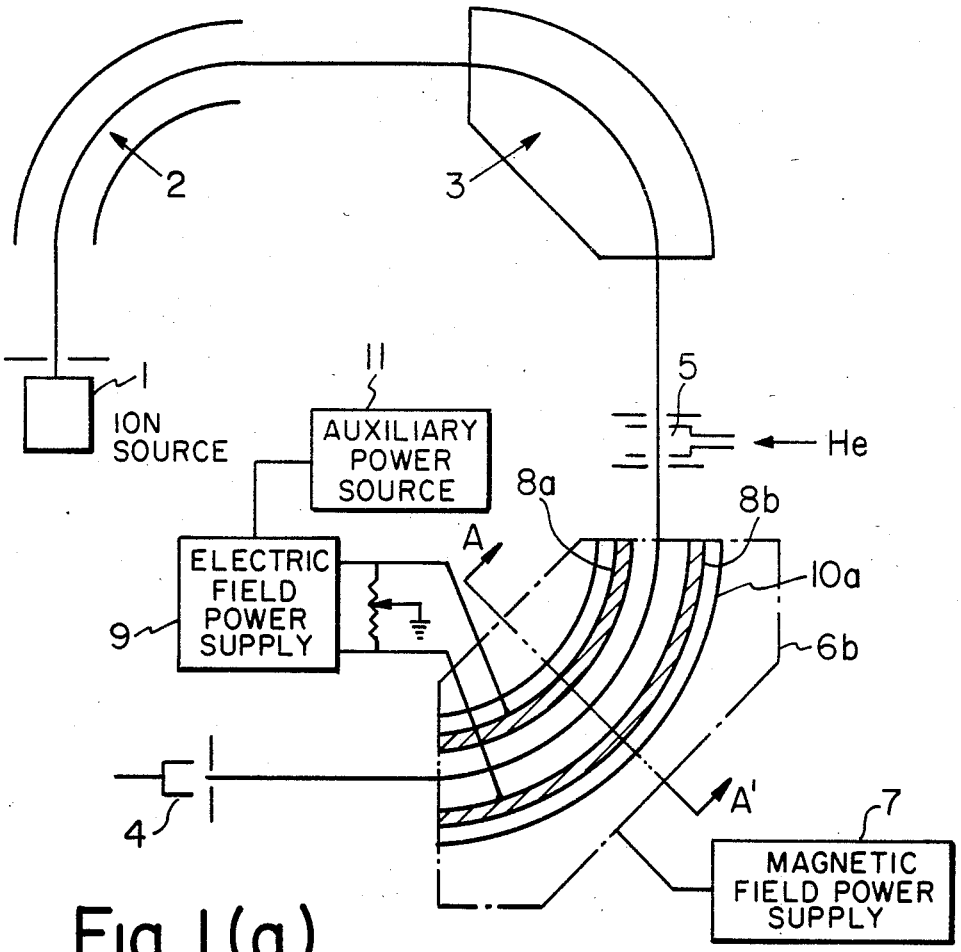
FIG. 1 is a schematic diagram showing the structure of an MS/MS instrument whose latter stage is formed by a superimposed-field mass spectrometric unit.
Figure 1B:
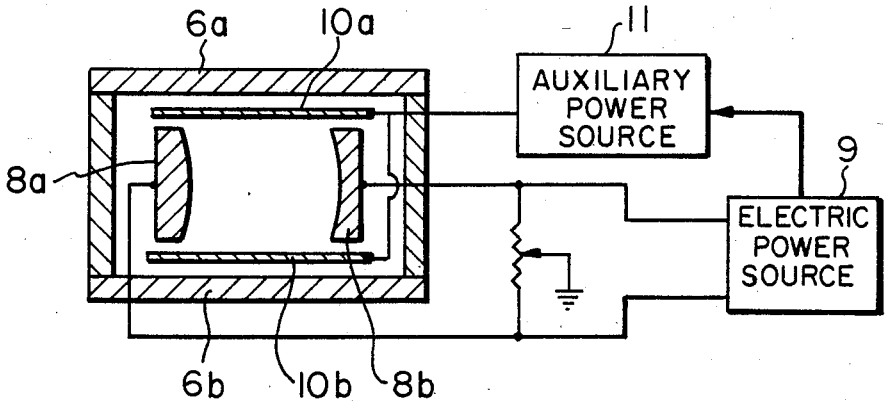

It is now assumed that the first mass spectrometric unit of the MS/MS instrument shown in FIG. 1 selects parent ions $m_0+$, that the parent ions cleave as given by $$m_0^+ \rightarrow m_x^+ + (m_0 - m_x) \quad (1)$$

in the collision chamber 5, and that daughter ions $m_x^+$ and neutral particles $(m_0 - m_x)$ are produced. If the velocity $V_0$ of the ions does not change before and after cleavage, then the energy of the parent ions $m_0^+$ and the energy of the daughter ions $m_x^+$ are given by $$E_0 = m_0 \cdot V_0^2/2 \quad (2)$$

$$E_x = m_x \cdot V_0^2/2 \quad (3)$$

Therefore, the following relation holds between $E_0$ and $E_x$:

$$E_x = (m_x/m_0)E_0 \quad (4)$$

The generated daughter ions $m_x^+$ are introduced into the second mass spectrometric unit having the superimposed fields, together with the parent ions $m_0^+$ which have not been fragmented. We now define symbols to specify the conditions under which the parent ions $m_0^+$ are detected by the second mass spectrometric unit having the superimposed fields, almost all of the symbols being given a subscript "0".

- The voltage for producing the electric field of the superimposed fields: $Vd_0$
- The intensity of the magnetic field of the superimposed fields: $B_0$
- The radius of curvature at which ions are deflected in the superimposed fields: a
- The radius of curvature at which ions are deflected when only the electric field acts on them: $ae_0$
- The radius of curvature at which ions are deflected when only the magnetic field acts on them: $am_0$
- The mass of the ions detected when the intensity of the electric field is null: $M_{00}$
- The voltage for producing the electric field when ions having infinitely large masses are detected: $V_{00}$ Similarly, we define some other symbols to specify the conditions under which the daughter ions $m_x^+$ are detected by the mass spectrometric unit having the superimposed fields, almost all the symbols being given a subscript "x".

- The voltage for producing the electric field of the superimposed field: $Vd_x$
- The intensity of the magnetic field of the superimposed fields: $B_x$
- The radius of curvature at which ions are deflected in the superimposed fields: a
- The radius of curvature at which ions are deflected when only the electric field acts on them: $ae_x$
- The radius of curvature at which ions are deflected when only the magnetic field acts on them: $am_x$ In general, in a superimposed-field mass spectrometric unit or mass spectrometer, the mass $m_0$ of parent ions are given in terms of $M_{00}$ and $V_{00}$ as follows:

$$Vd_0/V_{00} + \sqrt{M_{00}/m_0} = 1 \quad (5)$$

Since the radius of curvature at which ions are deflected is the sum of the radius of curvature when only the electric field acts on them and the radius of curvature when only the magnetic field acts on them, the following relations hold regarding the parent and daughter ions:

$$1/a = 1/ae_0 + 1/am_0 \quad (6)$$

$$1/a = 1/ae_x + 1/am_x \quad (7)$$

We now discuss the case where the magnetic field intensity $B_0$ of the superimposed fields is constant. Since the force that ions receive is balanced against the centrifugal force of the circular motion, the following relationships hold:

$$m_0 V_0^2/am_0 = ev_0 B_0 \quad (8)$$

$$m_x V_0^2/am_x = ev_0 B_0 \quad (9)$$

Thus, from equations (8) and (9) we obtain $$am_0/am_x = m_0/m_x \quad (10)$$

It is then assumed that the velocity of ions having the mass $M_{00}$ which are detected when the intensity of the electric field is zero equals $v_{00}$. Similarly to equations (8) and (9), the following equation results:

$$M_{00} V_{00}^2/a = ev_{00} B_0 \quad (11)$$

Because the accelerating voltage is maintained constant, and because the same energy is given to the parent ions $m_0^+$ and to the ions having the mass $M_{00}$, the following equation is obtained:

$$M_{00} V_{00}^2/2 = m_0 v_0^2/2 \quad (12)$$

By eliminating $V_{00}$, $B_0$, and e from equations (8), (11), and (12), the following equation is provided:

$$a/am_0 = \sqrt{M_{00}/m_0} \quad (13)$$

From this equation (13) and from equation (10), we can have the relations $$a/am_x = aam_0/am_0 am_x = (m_0/m_x)\sqrt{M_{00}/m_0} \quad (14)$$

With respect to the electric field, the force that ions receive in the field is balanced against the centrifugal force of the circular motion. Therefore, the following equations hold regarding parent and daughter ions:

$$m_0 v_0^2/ae_0 = -eE_0 = -eVd_0/d \quad (15)$$

$$m_x v_0^2/ae_x = -eE_x = -eVd_x/d \quad (16)$$

where d is the space between the electrodes 8*a* and 8*b*. Thus, from equations (15) and (16) we have $$ae_0/ae_x = (Vd_x/Vd_0)(m_0/m_x) \quad (17)$$

With respect to the voltage $V_{00}$ for producing the electric field that is used to detect parent ions having infinitely large masses, we find $$m_z v_{z0}^2/a = -eV_{00}/d \quad (18)$$

where $m_z$ and $V_{z0}$ are the mass and the velocity, respectively, of the parent ions. Since they are accelerated by the same accelerating voltage, the energy that the parent ions having infinitely large masses possess is equal to the energy that the parent ions having the mass $m_0$ possess. Therefore, equation (18) can be written in the form $$m_0 v_0^2/a = -eV_{00}/d \tag{19}$$

From equations (19) and (15), we have $$a/ae_0 - Vd_0/V_{00} \tag{20}$$

The following equations can be derived from equations (20) and (17):

$$\begin{aligned} a/ae_x &= (a/ae_0)(ae_0/ae_x) \\ &= (Vd_0/V_{00})(Vd_x/Vd_0)(m_0/m_x) \\ &= (Vd_x/V_{00})(m_0/m_x) \end{aligned} \tag{21}$$

By substituting equations (21) and (14) into equation (7), we have $$a/ae_x + a/am_x = (Vd_x/V_{00})(m_0/m_x) + (m_0/m_x)\sqrt{M_{00}/m_0} = 1 \tag{22}$$

Equation (22) can also be changed into the form $$Vd_x/V_{00} + \sqrt{M_{00}/m_0} = m_x/m_0 \tag{23}$$

Either equation (22) or (23) is considered to indicate the relation of the daughter ions $m_x^+$ to the voltage $vd_x$ for producing the dielectric field used to be detected when $V_{00}$, $M_{00}$, and $m_0$ are given. Especially when the condition in which the parent ions $m_0^+$ are detected is set as an initial condition, the requirement given by equation (5) is satisfied simultaneously. By substracting both sides of equation (5) from both sides of equation (23), we have $$m_x/m_0 = 1 - (Vd_0 - Vd_x)V_{00} \tag{24}$$

Since $m_0$, $Vd_0$, and $V_{00}$ are known, it can be seen from equation (24) that $m_x$ is a linear function of $Vd_x$.

Figure 2:
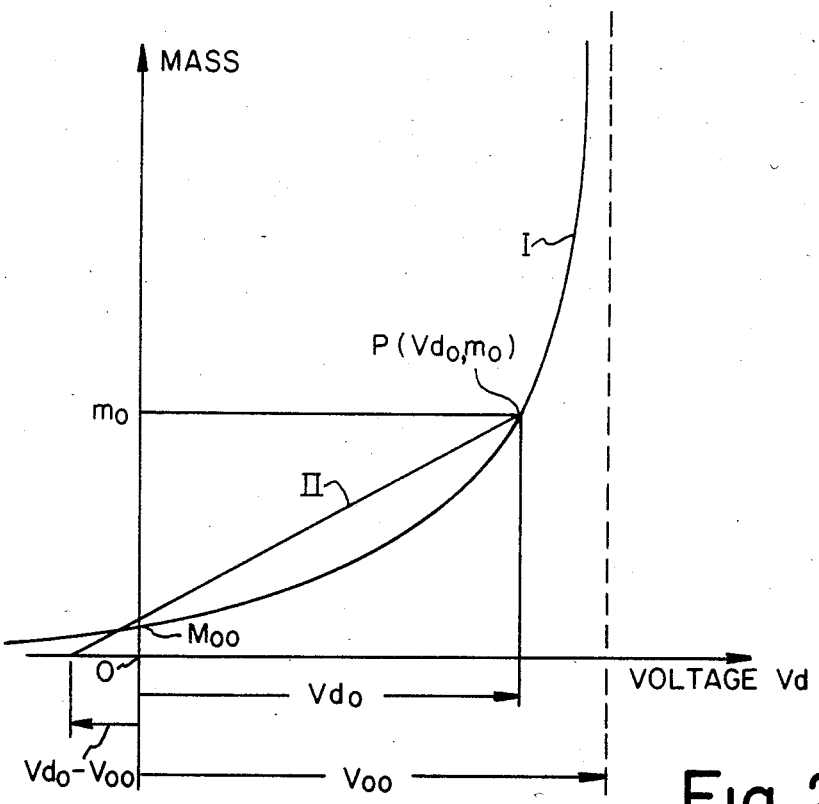
FIG. 2 is a graph for illustrating the relations given by equations (24) and (5)

FIG. 2 is a graph showing the relations expressed by equations (24) and (5). This graph is formed by giving the mass number M of the detected ions against the voltage Vd for producing the electric field. In FIG. 2, I indicates a sweep curve for parent ions based on equation (5). It can be seen from this graph that the mass is $M_{00}$ when the voltage Vd is zero and that the mass is infinity when the voltage is $V_{00}$. Indicated by II is a sweep straight line for daughter ions based on equation (24). This line passes through a point P ($Vd_0$, $m_0$), and has a gradient of $-m_0/V_{00}$. It will be understood from this graph that a daughter ion scan can be made by drawing a line from the point P along the stright line II in the direction indicated by the arrow, i.e., the voltage Vd is swept according to this line. As pointed out already, starting point P indicates the condition in which the parent ions $m_0^+$ is detected. Thus, all the daughter ions stemming from the parent ions are successively detected, and the spectra of the daughter ions can be obtained.

We have thus far set forth the case where the intensity of the magnetic field is constant and the voltage for producing the electric field is swept. We now discuss the situation where both the voltage for producing the electric field and the intensity of the magnetic field are swept to detect identical parent ions $m_0^+$ and daughter ions $m_x^+$. When the intensity of the magnetic field changes from $B_0$ to $B_x$, the voltage $V_{00}$ remains constant, but the mass $M_{00}$ changes to a value $M_{00}'$, for example, and the voltage for producing the electric field used to detect the same ions is also changed to another value $Vd_x'$, for instance. Then, the following relation holds between $Vd_x'$ and $M_{00}'$, corresponding to equation (23):

$$Vd_x'/V_{00} + \sqrt{M_{00}'/m_0} = m_x/m_0 \tag{25}$$

Where only the magnetic field exists, the requirement imposed by equation (11) is met, as mentioned previously. At this time, the energy that the ions having the mass $M_{00}$ possess is given by $$M_{00} v_{00}^2/2 = eVa \tag{26}$$

where Va is the voltage for accelerating ions. From equations (26) and (11), we obtain $$\sqrt{M_{00}Va} = \sqrt{e/2}\ B_0 a \tag{27}$$

Exactly the same concept applies to the case where the intensity of the magnetic field is $B_x$. Hence, $$\sqrt{M_{00}'Va} = \sqrt{e/2}\ B_x a \tag{28}$$

Elimination of $M_{00}$ from equation (25) using equations (28) and (27) results in $$Vd_x'/V_{00} + (B_x/B_0)\sqrt{M_{00}/m_0} = m_x/m_0 \tag{29}$$

By substituting $Vd_x'$ for $Vd_x$, we have $$Vd_x/V_{00} + (B_x/B_0)\sqrt{M_{00}/m_0} = m_x/m_0 \tag{29'}$$

This equation (29') indicates the most general relation that holds for the superimposed fields when the parent ions break up into the daughter ions.

Figure 3:
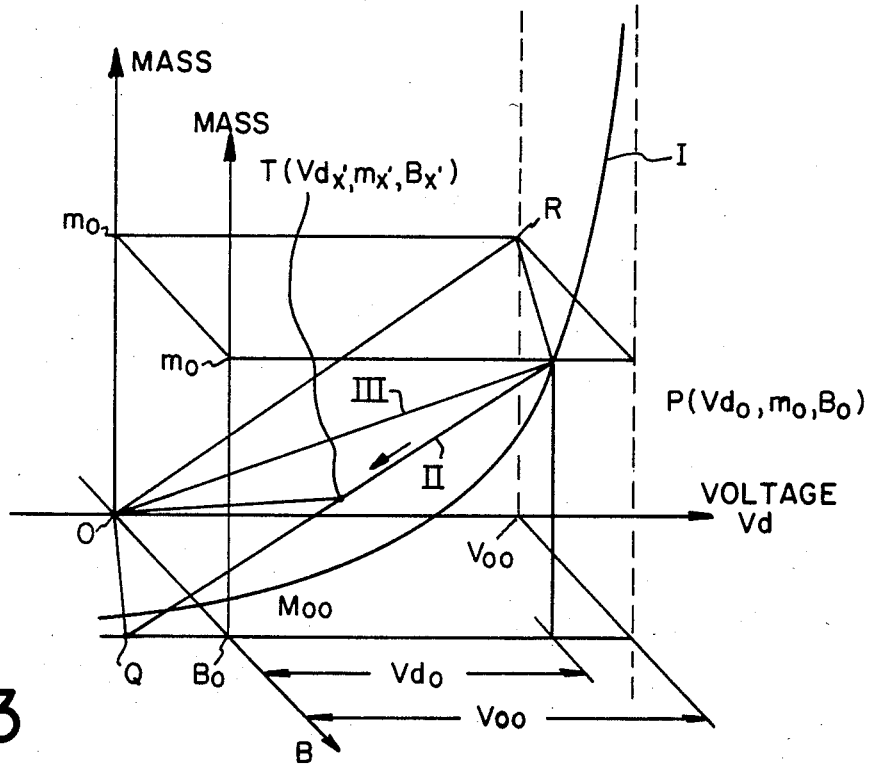
FIG. 3 is a graph for illustrating the relations given by equations (29), (24), and (5)

FIG. 3 is a graph showing the relations expressed by equations (29'), (24), and (5). This graph is given three-dimensionally, with the magnetic field B of the superimposed fields given on the third axis, the first and second axes being similar to those shown in FIG. 2. It is to be noted that the graph of FIG. 2 represents those relations which hold only on the plane $B = B_0$ in FIG. 3. The point P ($Vd_0$, $m_0$) is given as P ($Vd_0$, $m_0$, $B_0$) in FIG. 3. When the point P is set, i.e., when the parent ions $m_0^+$ are determined, all the daughter ions $m_x(Vd_x, B_x)$ which are produced from the parent ions $m_0^+$ are expressed as a linear function of the voltage Vd for producing the electric field and of the magnetic field intensity B, and they lie on a plane, or a parallelogram PQOR, one of the corners of which lies at the point P in FIG. 3. Thus, by making a sweep along this plane, a daughter ion scan can be made to detect all the ions originating from the parent ions $m_0^+$. The daughter ion scan to which the present invention closely pertains is next described in detail by referring to FIG. 3.

First, parent ions $m_0^+$ of interest are selected using the first mass spectrometric unit, which is then made stationary in such a way that the parent ions $m_0^+$ always enter the collision chamber 5. Under this condition, each parent ion $m_0^+$ may cleave to thereby produce one or more daughter ions inside the collision chamber 5. The daughter ions are introduced into the superimposed fields, together with the parent ions which have not been fragmented. The second mass spectrometric unit having the superimposed fields is so set that these parent ions $m_0^+$ are detected. This causes the operating point to be set at the point P ($Vd_0$, $m_0$, $B_0$). The voltage Vd or the magnetic field intensity is swept singly or both are swept in an interrelated manner from the point P toward the bottom QO of the quadrangle PQOR along an arbitrary curve or straight line on the plane.

The aforementioned sweep made along the line II is an example of this sweep. Since the electric field is swept while the magnetic field is maintained constant, the sweep itself is easy to perform. However, the converging conditions for the superimposed fields are required to be corrected corresponding to the sweep, because the conditions vary during the sweep.

As another example, a sweep is made along a straight line III (PO) which connects the point P and the origin O. Now let an arbitrary point ($Vd_x$, $m_x$, $B_x$) lie on this line. Then, we have $$m_x/m_0 = Vd_x/Vd_0 = B_x/B_0 \tag{30}$$

Thus, the voltage for producing the electric field should be swept from $Vd_0$ to zero at a certain gradient, and the intensity of the magnetic field should be swept from $B_0$ to zero at a certain gradient in step with the sweep of the voltage.

This sweep along the straight line always maintains the value of $a/ae_x = (Vd_x/V_{00})(m_0/m_x)$ given by equation (21) constant, thus retaining the converging conditions for the superimposed fields constant. This offers the advantage that the converging conditions are not required to be corrected during the sweep.

As a further example, a sweep is made along a bent line PTO. This sweep may be considered to be the combination of the aforementioned two examples. An arbitrary point on the line PT is given by equation (22) or (23). Assuming that the coordinates of the point T are ($Vd_x'$, $m_x'$, $B_x'$), an arbitrary point ($Vd_x$, $m_x$, $B_x$) on the line TO is given by the following relations corresponding to equation (30):

$$m_x/m_x' = Vd_x/Vd_x' = B_x/B_x' \tag{31}$$

Figure 4:
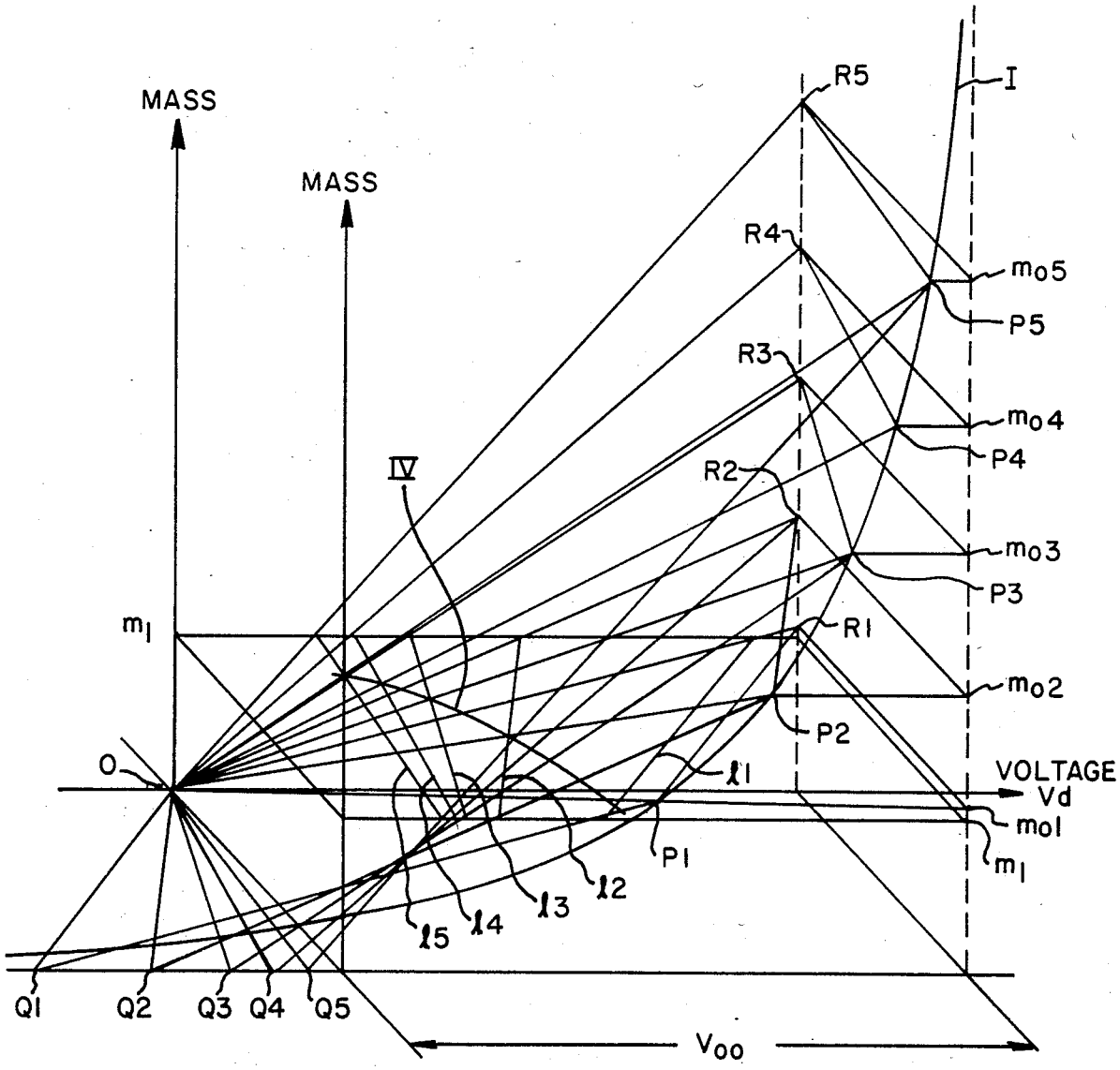
FIG. 4 is a diagram for illustrating a parent ion scan.

Referring next to FIG. 4, there are shown five quadrangles P1Q1OR1, P2Q2OR2, P3Q3OR3, P4Q4OR4, and P5Q5OR5 on which daughter ions produced from parent ions $m_01^+$, $m_02^+$, $m_03^+$, $m_04^+$, $m_05^+$ are plotted in accordance with the above concept. A plane C is assumed in which $m = m_1$. The intersections of the plane C with these quadrangles are straight lines l1, l2, l3, l4, l5, respectively. The daughter ions existing on the lines all have the same mass of $m_1$, but the masses of their parent ions are different from each other. Therefore, by making a sweep along the plane C across the lines l1–l5, as for example, along a curve IV, all the parent ions producing daughter ions $m_1^+$ can be obtained. That is, a parent ion scan can be made. It is to be noted, however, that those which are detected after passing through the superimposed fields are, of course, the daughter ions having the mass $m_1$ at all times. Notice also that the curve IV connects the points on the planes and on the straight line III already described in connection with FIG. 3.

To make the parent ion scan in this way is given by $$Vd_y/V_{00} + (B_y/B_0)\sqrt{M_{00}/m_y} = m_1/m_y \tag{32}$$

This has been derived by replacing the daughter and parent ions $m_x$ and $m_0$ of equation (29') with constant values $m_1$ and $m_y$, respectively. The voltage $Vd_y$ and the magnetic field intensity $B_y$ have been taken to be variable. This equation (32) is the fundamental formula for attaining a parent ion scan. Various sweeping processes may be contemplated which conform to this equation (32). We present an example of such processes below.

Assuming that the starting point of the sweep lies at ($Vd_0$, $B_0$, $m_{00}$) and from equation (32), we obtain $$Vd_0/V_{00} + \sqrt{M_{00}/m_{00}} = m_1/m_{00} \tag{33}$$

If K is made constant, and if $Vd_y$ is swept such that $$Vd_y/V_{00} = K(m_1/m_y) \tag{34}$$

holds for all the values of $m_y$, then it follows from equation (32) that $B_y$ must be swept according to $$(B_y/B_0)\sqrt{M_{00}/m_y} = (1 - K)\, m_1/m_y \tag{35}$$

Also regarding equation (33), the following equations are derived according to equations (34) and (35):

$$Vd_0/V_{00} = K(m_1/m_{00}) \tag{36}$$

$$\sqrt{M_{00}/m_{00}} = (1 - K)\, m_1/m_{00} \tag{37}$$

Elimination of K, $M_{00}$, and $V_{00}$ from equations (34)–(37) yields $$Vd_y/Vd_0 = m_{00}/m_y \tag{38}$$

$$B_y/B_0 = \sqrt{m_{00}/m_y} \tag{39}$$

All the parent ions $m_y^+$ producing the daughter ions $m_1$ can be obtained by sweeping $Vd_y$ and $B_y$ in accordance with equations (38) and (39).

More specifically, from equations (38) and (39) we derive the relation $$Vd_y/B_y^2 = Vd_0/B_0^2 \tag{40}$$

Figure 5A:
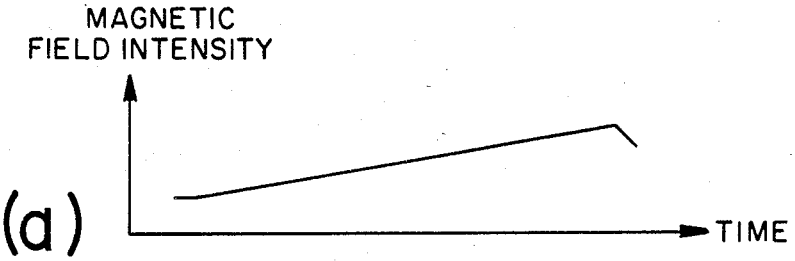
FIG. 5 is a waveform diagram for illustrating a sweeping process according to the present invention.
Figure 5B:
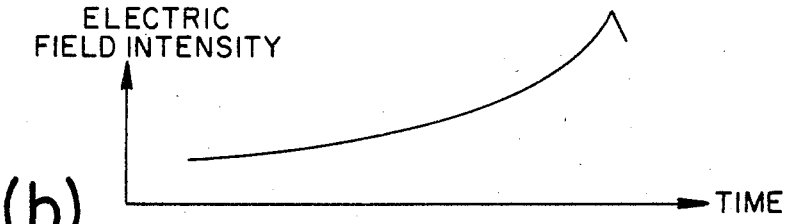

The right side of equation (40) is a constant determined by the starting point of the sweep. Thus, $Vd_y$ and $B_y$ should be swept while keeping the value of $Vd_y/B_y^2$ constant. In particular, the magnetic field intensity of the superimposed fields is changed linearly with time, as shown in FIG. 5(*a*), by the magnetic field power supply 7. At the same time, the voltage applied by the electric field power supply to produce the electric field of the superimposed fields is changed as a quadratic function with time as shown in FIG. 5(*b*).

Those which are selected by the superimposed-field mass spectrometric unit and detected are invariably daughter ions $m_1^+$. The parent ions $m_y^+$ from which the daughter ions $m_1^+$ are derived vary with the advance of the sweep. Hence, if the mass spectrometric unit at the front stage is fixed as during a daughter ion scan, only specific parent ions are allowed to enter the collision chamber 5. Consequently, when a sweep is done according to equations (38) and (39), it is necessary that a sweep is made in double-focusing mass spectrometric unit consisting of the electric field 2 and the magnetic field 3 at the front stage in step with the sweep made in the superimposed fields, in order that the parent ions producing the daughter ions just selected by the superimposed-field mass spectrometric unit enter the collision chamber 5. Where the mass spectrometric unit at the front stage is not mounted and all the parent ions produced by the ion source 1 go into the collision chamber 5 at the same time, i.e., when a mass spectrometer having a single set of superimposed fields is used rather than an MS/MS instrument, the above requirement, of course, is not required to be met.

The sweep based on equations (38) and (39) is made along the aforementioned curve IV, and during the period of this sweep the value $(Vd_y/V_{00})(m_y/m_1)$ given by equation (21) is maintained constant at all times. This keeps the convering conditions for the superimposed fields constant, thus eliminating the need to correct for the converging conditions during the sweep.

We have set forth only one example of the sweeping process conforming to equation (32), and various other sweeping processes may be contemplated. In short, a parent ion scan in which all the parent ions producing daughter ions $m_1^+$ can be obtained is made possible by sweeping the voltage for producing the electric field or the magnetic field intensity singly or by sweeping both in an interrelated manner on the plane C across the lines 11–15 along an appropriate curve or straight line.

The daughter ion scan and the parent ion scan which are closely related to the present invention have been described thus far. Substituting $m_0=m_x$ of equation (1) for $m_n$ results in $$m_0^+ \rightarrow m_x^+ + m_n \tag{41}$$

The above-mentioned daughter ion scan is made under the condition that $m_0$ is constant. Also, the parent ion scan is made under the condition that $m_x$ is constant. Similarly, $m_n$ is rendered constant to make a neutral loss scan for obtaining all the parent ions which produce neutral particles $m_n$ of the specific mass $m_n$ by cleavage. From equation (41) we have $$m_x = m_0 - m_n$$

By inserting this into equation (29), making $Vd_n$ and $B_n$ variables, and expressing the parent ion $m_0$ as a function of $Vd_n$ and $B_n$ in the form of $m_{0n}$ $(Vd_n, B_n)$, we have $$Vd_n/V_{00} + (B_n/B_0)\sqrt{M_{00}/m_{0n}} = 1 - m_n/m_{0n} \tag{42}$$

Assuming that the starting point of the sweep is given by $m_{00}=m_{0n}$ $(Vd_0, B_0)$, equation (42) expresses a curved surface in the same manner as the foregoing daughter ion scan and parent ion scan. Thus, by sweeping both the voltage for producing the electric field and the magnetic field intensity along this curved surface, a scan is made to obtain all the parent ions that give rise to certain neutral particles $m_n$.

As a simple example, a scan can be provided which satisfies the condition $$B_n/B_0 = K\sqrt{m_{0n}/M_{00}}$$

The constant K of this formula is so selected that $$K = \sqrt{M_{00}/m_{00}} = 1 - m_n/m_{00} - Vd_0/V_{00}$$

In this case, $Vd_n$ is given by $$\begin{aligned} Vd_n/V_{00} &= (1 - K) - m_n/m_{0n} \\ &= Vd_0/V_{00} - m_n/m_{0n} + m_n/m_{00} \end{aligned} \tag{43}$$

Eventually, $Vd_n$ is expressed by $$(Vd_n - Vd_0)/V_{00} = (m_n/m_{00})(1 - m_{00}/m_{0n}) \tag{44}$$

The intensity $B_n$ is given by $$B_n = B_0\sqrt{m_{0n}/m_{00}} \tag{45}$$

Thus, it is possible to make a scan to obtain all the parent ions $m_{0n}$ arising from the certain neutral particles $m_n$ by sweeping $Vd_n$ and $B_n$ in accordance with equations (44) and (45).

As a further example, we can provide a scan which fulfills the requirement defined by the following equation:

$$a/ae_x = (Vd_n/V_{00})(m_{0n}/(m_{0n} - m_n)) = K \tag{46}$$

If this requirement is met, the converging conditions are maintained constant and so it is adapted for actual instruments. Under the above condition for the scan, the following equation holds especially at an initial condition $m_{0n}=m_{00}$:

$$(Vd_0/V_{00})(m_{00}/(m_{00} - m_n)) = K \tag{47}$$

Also, from equations (42) and (46) we have $$(B_n/B_0)(m_{0n}/(m_{0n} - M_n)) \times \sqrt{M_{00}/m_{0n}} = 1 - K \tag{48}$$

If $B_n=B_0$ for equation (48), then we can get $$(m_{00}/(m_{00} - m_n)) \times \sqrt{M_{00}/m_{00}} = 1 - K \tag{48'}$$

Combining equation (46) with equation (47) results in $$Vd_n - Vd_0(1 - m_n/m_{0n})/(1 - m_n/m_{00}) \tag{49}$$

Similarly, combining equation (48) with equation (48′) yields $$B_n = B_0\sqrt{m_{00}/m_{0n}}\,((n_{0n} - m_n)/(m_{00} - m_n)) \tag{50}$$

The scan which permits all the parent ions producing the certain neutral particles $m_n$ to be obtained can be made by sweeping $Vd_n$ and $B_n$ in accordance with equations (49) and (50).

I claim:

1. A process for a mass spectrometer having superimposed magnetic field B and electric field E perpendicular to the magnetic field for detecting the mass $m_x$ of fragment species arising from parent ions having mass $m_0$ comprising sweeping the deflection conditions in such a way that voltage $Vd_x$ for producing the electric field and the intensity $B_x$ of the magnetic field at all times satisfy the relation $$Vd_x/V_{00} + (B_x/B_0)\sqrt{M_{00}/m_0} = f(m_x/m_0)$$

where $V_{00}$, $B_0$ and $M_{00}$ are constants and $f(m_x/m_0)$ is a simple algebraic function of variables $m_x$ and $m_0$.

2. A sweeping process for a mass spectrometer having superimposed magnetic field B and electric field E perpendicular to the magnetic field for detecting daughter ions having a mass $m_x$ arising from parent ions having a mass $m_0$ comprising sweeping the deflection condition in such a way that the voltage $Vd_x$ for producing the electric field and the intensity $B_x$ of the magnetic field at all times satisfy the relation $$Vd_x/V_{00} + (B_x/B_0)\sqrt{M_{00}/m_0} = m_x/m_0$$

where $V_{00}$ is the voltage for producing the electric field used to detect ions having infinitely large masses, $B_0$ is the intensity of the magnetic field when the parent ions are detected, and $M_{00}$ is the mass of the parent ions detected when the intensity of the electric field is zero.

3. A sweeping process for a mass spectrometer having superimposed magnetic field B and electric field E perpendicular to the magnetic field for determining the mass $m_y$ of all the parent ions producing daughter ions having a mass $m_1$ comprising sweeping the deflection conditions in such a way that the voltage $Vd_y$ for producing the electric field and the intensity $B_y$ of the magnetic field at all times satisfy the relation $$Vd_y/V_{00} + (B_y/B_0)\sqrt{M_{00}/m_0} = m_1/m_y$$

where $V_{00}$ is the voltage for producing an electric field used to detect ions having infinitely large masses, $M_{00}$ is the mass of the parent ions detected when the intensity of the electric field is zero, and $B_0$ is the intensity of the magnetic field when the parent ions are detected under such a condition.

4. A sweeping process for a mass spectrometer having superimposed magnetic field B and electric field E perpendicular to the magnetic field for determining the mass $m_0n$ of all the parent ions producing neutral particles having a mass $m_n$ by cleavage comprising sweep in the deflection condition in such a way that the voltage $Vd_n$ for producing the electric field and the intensity $B_n$ of the magnetic field at all times satisfy the relation $$Vd_n/V_{00} + (B_n/B_0)\sqrt{M_{00}/m_0n} = 1 - m_n/m_0n$$

where $V_{00}$ is the voltage for producing the electric field used to detect ions having infinitely large masses, $M_{00}$ is the mass of the parent ions detected when the intensity of the electric field is zero, and $B_0$ is the intensity of the magnetic field when the parent ions are detected under such a condition.

* * * * *

UNITED STATES PATENT AND TRADEMARK OFFICE

CERTIFICATE OF CORRECTION

PATENT NO. : 4,588,889

DATED : May 13, 1986

INVENTOR(S) : Motohiro Naito

It is certified that error appears in the above-identified patent and that said Letters Patent is hereby corrected as shown below:

In the line listing the Foreign Application Priority Data:

"Feb. 27, 1984" should read — Feb. 17, 1984—.

Column 9 Line 29 "convering" should read —converging—.

Claim 3 - Column 12 Line 11 "$m_0$" should read —$m_y$—.

Signed and Sealed this

*Fifth* Day of *August 1986*

[SEAL]

*Attest:*

DONALD J. QUIGG

*Attesting Officer*

*Commissioner of Patents and Trademarks*